US008142644B2

(12) United States Patent
Bijlsma et al.

(10) Patent No.: US 8,142,644 B2
(45) Date of Patent: Mar. 27, 2012

(54) PROCESS FOR HYDROCRACKING AND HYDRO-ISOMERISATION OF A PARAFFINIC FEEDSTOCK

(75) Inventors: Focco Kornelis Bijlsma, Amsterdam (NL); Jan Lodewijk Maria Dierickx, Amsterdam (NL); Arend Hoek, Amsterdam (NL)

(73) Assignee: Shell Oil Company, Houston, TX (US)

( * ) Notice: Subject to any disclaimer, the term of this patent is extended or adjusted under 35 U.S.C. 154(b) by 639 days.

(21) Appl. No.: 12/208,160

(22) Filed: Sep. 10, 2008

(65) Prior Publication Data

US 2009/0200203 A1 Aug. 13, 2009

(30) Foreign Application Priority Data

Sep. 10, 2007 (EP) ..... 07115986

(51) Int. Cl.
*C10G 47/14* (2006.01)

(52) U.S. Cl. ..... 208/111.01; 208/107; 208/108; 208/109; 208/110; 208/950; 585/734; 585/737; 585/739; 585/750; 585/751

(58) Field of Classification Search ..... 585/752, 585/734, 739, 750, 751, 737; 208/950, 107, 208/108, 109, 110, 111.01; 502/300, 325, 502/339, 334
See application file for complete search history.

(56) References Cited

U.S. PATENT DOCUMENTS

| | | | | |
|---|---|---|---|---|
| 3,843,509 | A * | 10/1974 | Suto et al. | 208/111.1 |
| 5,292,989 | A * | 3/1994 | Davis | 585/751 |
| 5,370,788 | A | 12/1994 | Dai et al. | |
| 2004/0206667 | A1 * | 10/2004 | Calemma et al. | 208/57 |
| 2006/0144755 | A1 * | 7/2006 | Benazzi et al. | 208/108 |
| 2007/0017850 | A1 * | 1/2007 | Euzen et al. | 208/58 |
| 2007/0193923 | A1 * | 8/2007 | Dierickx et al. | 208/27 |

FOREIGN PATENT DOCUMENTS

| | | |
|---|---|---|
| EP | 666894 | 8/1995 |
| EP | 1366135 | 9/2002 |
| EP | 537815 | 4/2003 |
| EP | 1366134 | 12/2003 |
| WO | WO9302161 | 2/1993 |
| WO | WO9410263 | 5/1994 |
| WO | WO02099014 | 12/2002 |
| WO | WO03004584 | 1/2003 |
| WO | WO2005005575 | 1/2005 |

* cited by examiner

*Primary Examiner* — In Suk Bullock
*Assistant Examiner* — Bradley Etherton

(57) ABSTRACT

A process for hydrocracking and hydro-isomerization of a paraffinic feedstock obtained by Fischer-Tropsch hydrocarbon synthesis comprising at least 50 wt % of components boiling above 370° C. to obtain a hydro-isomerized feedstock, the process comprising contacting the feedstock, in the presence of hydrogen, at elevated temperature and pressure with a catalyst comprising a hydrogenating compound supported on a carrier comprising amorphous silica-alumina, the carrier having a pore volume of at least 0.8 ml/g, wherein at most 40% of the pore volume comes from pores having a pore diameter above 35 nm and wherein at most 20% of the pore volume comes from pores having a pore diameter below 50 Å and above 37 Å, the carrier having a median pore diameter of at least 85 Å, wherein the product of (surface area per pore volume) and (median pore diameter as measured by mercury intrusion porosimetry) of the carrier is at least 34,000 Å·$m^2$/ml.

12 Claims, No Drawings

PROCESS FOR HYDROCRACKING AND HYDRO-ISOMERISATION OF A PARAFFINIC FEEDSTOCK

This application claims the benefit of European Application No. 07115986.7 filed Sep. 10, 2007.

FIELD OF THE INVENTION

The present invention provides a process for hydrocracking and hydro-isomerisation of a paraffinic feedstock obtained by Fischer-Tropsch hydrocarbon synthesis comprising at least 50 wt % of components boiling above 370° C. to obtain a hydro-isomerised feedstock.

BACKGROUND OF THE INVENTION

It is known to produce gasoil and waxy raffinate from paraffinic feedstocks derived from a Fischer-Tropsch hydrocarbon synthesis process, by a combined hydrocracking/hydro-isomerisation step.

Catalysts used for hydrocracking/hydro-isomerisation of such feedstock typically are dual function catalysts comprising a hydrogenation function and an acid cracking function.

It is also known that the catalyst characteristics have an effect on the quantity and quality of the products obtained in the hydrocracking/hydro-isomerisation step. In EP 537 815 A1 for example is disclosed that a platinum on amorphous silica-alumina catalyst that is prepared from an amorphous silica-alumina starting material having a pore volume of at least 1.0 ml/g exhibits a significantly higher selectivity to middle distillates than catalysts comprising carriers prepared from starting materials having lower pore volumes.

In EP 666 894 B1 is disclosed a process for preparing a lubricating base oil from a waxy hydrocarbon feed, such as for example a synthetic wax prepared by a Fischer-Tropsch synthesis, wherein the feed is contacted in the presence of hydrogen with a catalyst comprising a hydrogenation component on an amorphous silica-alumina carrier having a macroporosity in the range of from 5 to 50 vol % and a total pore volume in the range of from 0.6 to 1.2 ml/g. Macroporosity is defined in EP 666 894 as the fraction of the total pore volume of the carrier present in pores with a diameter greater than 35 nm.

In WO 2005/005575 it is disclosed that the use of a relatively heavy Fischer-Tropsch derived feedstock in a hydrocracking/hydro-isomerisation process results in a higher yield of waxy raffinate product, i.e. the fraction boiling between 370 and 540° C., and an improved quality of the waxy raffinate product. In particular the wax content of the waxy raffinate product is reduced, resulting in improved cold flow properties and a simpler and more efficient subsequent dewaxing step.

There is still room for improvement in terms of the yield and quality of the products obtained, in particular gasoil and waxy raffinate, in a process for hydrocracking/hydro-isomerisation of Fischer-Tropsch derived feedstocks.

SUMMARY OF THE INVENTION

It has now been found that for hydrocracking/hydro-isomerisation catalysts with an amorphous silica-alumina carrier, not only the pore volume and the pore diameter have an important effect on the products obtained in hydrocracking/hydro-isomerisation of a paraffinic feedstock, but also the shape of the pores. A catalyst with a carrier comprising amorphous silica-alumina having a larger percentages of pores with a cylindrical shape, i.e. pores having a larger product of (pore surface area per pore volume) and (pore diameter at the most constricted passage), results in a higher degree of isomerisation of the product and higher yields of higher boiling products, especially if a heavy feedstock is used. The pore diameter at the most constricted passage can suitably be measured by mercury porosimetry.

Accordingly, the present invention provides a process for hydrocracking and hydro-isomerisation of a paraffinic feedstock obtained by Fischer-Tropsch hydrocarbon synthesis comprising at least 50 wt % of components boiling above 370° C. to obtain a hydro-isomerised feedstock, the process comprising contacting the feedstock, in the presence of hydrogen, at elevated temperature and pressure with a catalyst comprising a hydrogenating compound supported on a carrier comprising amorphous silica-alumina, the carrier having a pore volume of at least 0.8 ml/g, a median pore diameter of at least 85 Å, wherein the product of (surface area per pore volume) and (median pore diameter as measured by mercury porosimetry) of the carrier is at least 34,000 $Å \cdot m^2/ml$.

The hydro-isomerised feedstock obtained is typically fractionated in at least a fraction boiling in the gasoil boiling point range and a waxy raffinate product that can serve as a feedstock for the preparation of a lubricating base oil. An advantage of the process according to the invention is that the gasoil thus-obtained has very good cold flow properties, in particular a very low pour point.

Another advantage is that the waxy raffinate product has a relatively low content of straight chain hydrocarbons and therefore can be used as lubricating base oil without a further dewaxing step, or with minimal dewaxing.

DETAILED DESCRIPTION OF THE INVENTION

In the process according to the invention, a paraffinic feedstock obtained in a Fischer-Tropsch hydrocarbon synthesis process is hydrocracked and hydro-isomerised over a catalyst comprising a hydrogenating compound supported on a carrier comprising amorphous silica-alumina.

The feedstock is a paraffinic feedstock obtained in a Fischer-Tropsch hydrocarbon synthesis process that comprises at least 50 wt % of compounds boiling above 370° C. Preferably, the feedstock comprises at least 70 wt % compounds boiling above 370° C. Preferably, the feedstock has a large amount of components boiling above 540° C. The weight ratio of compounds boiling above 540° C. and compounds boiling between 370 and 540° C. in the feedstock is preferably greater than 2. Such a feedstock may for example be prepared by separating from a Fischer-Tropsch synthesis product part or all of the paraffin fraction boiling between 370 and 540° C. and/or adding a Fischer-Tropsch derived fraction comprising compounds boiling above 540° C. to the Fischer-Tropsch synthesis product.

In the process according to the invention, part of the hydrocarbons are hydrocracked and part of the straight hydrocarbon chains are isomerised into branched paraffinic hydrocarbons. In order to obtain a high yield of waxy raffinate product and optimum cold flow properties of both the waxy raffinate product and the gasoil fraction obtained, the catalyst preferably has a relatively low hydrocracking activity and a relatively high isomerisation activity. In order to minimise the hydrocracking activity in favour of the desired isomerisation reaction, the catalyst carrier preferably comprises less than 10 wt % of crystalline phases such as molecular sieves, more preferably is devoid of crystalline phases.

The catalyst comprises a hydrogenating compound supported on a carrier comprising amorphous silica-alumina.

The hydrogenating compound may be any hydrogenating compound known in the art, typically one or more Group VIII and/or Group VIB metals or oxides or sulphides thereof. Examples of such hydrogenating compounds are Co and Ni, optionally in combination with Mo or W, preferably in sulphided form, Pt or Pd. Preferably, the hydrogenating compound is a noble metal, for example Pt or Pd or a combination thereof. More preferably the noble metal is Pt. An advantage of the use of a noble metal is that a noble metal is used in its reduced metallic form. Therefore, no sulphur compound needs to be added in order to keep the catalyst in its sulphided form, as is typically the case with catalysts comprising Co or Ni and W or Mo. Therefore, by using a noble metal the process can be operated in a sulphur-free manner, thereby not contaminating the feedstock and the products with sulphur compounds.

In case of a noble metal hydrogenating compound, the catalyst may comprise the hydrogenating compound in an amount of from 0.005 to 5.0 parts by weight, preferably from 0.02 to 2.0 parts by weight, per 100 parts by weight of carrier material. A preferred catalyst for use in the process according to the invention comprises a noble metal in an amount in the range of from 0.05 to 2.0 parts by weight, more preferably from 0.1 to 1.0 parts by weight, per 100 parts by weight of carrier material. In case of a non-noble metal hydrogenating compound, the amount of hydrogenating compound may be much higher, typically up to 20 wt % based on the weight of catalyst carrier.

In case of a noble metal hydrogenating compound, the hydrogenating compound preferably has a low dispersion on the carrier in order to prevent over-cracking of the feedstock. Preferably, the noble metal dispersion is at most 80%, more preferably at most 65%. A low metal dispersion can for example be obtained by calcining the carrier impregnated with the hydrogenation compound at a relatively high temperature. The metal dispersion can be example determined by carbon monoxide or hydrogen adsorption, for example according to BS 4359-4.

The hydrogenating compound is supported on a carrier comprising amorphous silica-alumina. The carrier may also comprise a binder to enhance the strength of the catalyst. The binder can be non-acidic. Examples of suitable binders are clay, alumina and other binders known to one skilled in the art.

The carrier has a relatively large pore volume, i.e. at least 0.8 ml/g, preferably at least 1.0 ml/g, a relatively large pore diameter, i.e. a median pore diameter of at least 85 Å, preferably at least 100 Å, and a relatively large product of (pore surface area per pore volume) and (median pore diameter as determined by mercury intrusion porosimetry).

In order to calculate the pore surface area per pore volume, the surface area is determined by BET nitrogen adsorption (ASTM D3663 is a suitable method for doing so) and usually expressed in $m^2$ surface area per gram of carrier material; the pore volume is determined by water, nitrogen, or mercury adsorption (for example by ASTM D4641) and usually expressed in ml pore volume per gram of carrier material.

The product of (pore surface area per pore volume) and (pore diameter as determined by mercury intrusion porosimetry) is a measure for the so-called cylindricity of the pores, i.e. the extent to which the pores approach the ideally cylindrical shape. Pores with a cylindricity of 100% are pores that have an ideal cylindrical shape, i.e. the pore diameter is constant over the total length of the pore. For ideally cylindrical pores, the pore surface area per pore volume is $4/d\ m^2/m^3$, wherein d is the pore diameter in meters. The product of (pore surface area per pore volume) and (pore diameter expressed in meters) is thus 4. If the pore surface area per pore volume is expressed in $m^2$/ml and the pore diameter in Å, then the product is 40,000 $Å \cdot m^2$/ml.

In case of non-ideally cylindrical pores, the product of (pore surface area per pore volume) and (pore diameter as determined by mercury intrusion porosimetry) is less than 40,000 $Å \cdot m^2$/ml. The pore diameter as determined by mercury intrusion porosimetry is the most constricted diameter of a pore, i.e. the diameter at the smallest passage. The pores of the carrier of the catalyst used in the process according to the invention have a cylindricity of at least 85%, preferably at least 90% of the cylindricity of ideally cylindrical pores. Thus, the product of (pore surface area per pore volume) and (pore diameter as determined by mercury intrusion porosimetry) has a value of at least 34,000 $Å \cdot m^2$/ml (85% of 40,000), preferably at least 36,000 $Å \cdot m^2$/ml (90% of 40,000).

Reference herein to pore diameter is to the median pore diameter by volume, i.e. 50% by volume of the pores has a diameter that is smaller than the median pore diameter and 50% by volume of the pores has a diameter that is larger than the median pore diameter. The median pore diameter by volume may suitably be measured by mercury intrusion porosimetry according to ASTM D4284.

The relevant carrier properties, i.e. surface area, pore volume and median pore diameter may be determined on the calcined carrier material or on the final catalyst, i.e. calcined carrier material impregnated with hydrogenating compound (s).

The catalyst carrier may have a macroporosity up to 40%, i.e. at most 40% of the pore volume comes from pores having a pore diameter above 35 nm. Preferably, at most 30%, more preferably at most 20%, of the pore volume comes from pores having a pore diameter above 35 nm. This can be determined by mercury intrusion porosimetry.

The catalyst carrier may have micropores. Preferably the amount of micropores is limited. For optimal catalyst properties, the amount of pores with a pore diameter below 70 Å is kept as low as possible.

A measure for the amount of micropores is the pore volume coming from pores having a pore diameter below 70 Å and above 37 Å, which can be determined by mercury intrusion porosimetry.

It has been found that for a catalyst carrier according to the present invention, preferably at most 20% of the pore volume comes from pores having a pore diameter below 50 Å and above 37 Å. More preferably at most 20% of the pore volume comes from pores having a pore diameter below 60 Å and above 37 Å, even more preferably at most 20% of the pore volume comes from pores having a pore diameter below 70 Å and above 37 Å.

Pores with a pore diameter below 70 Å have an influence on the determined value of the product of (pore surface area per pore volume) and (pore diameter as determined by mercury intrusion porosimetry). For a catalyst carrier according to the present invention, the product of (pore surface area per pore volume) and (pore diameter as determined by mercury intrusion porosimetry) preferably has a value of at most 44,000 $Å \cdot m^2$/ml, more preferably at most 42,000 $Å \cdot m^2$/ml, even more preferably at most 40,000 $Å \cdot m^2$/ml.

In a preferred embodiment, the pores of the catalyst carrier have a high cylindricity and a major portion of the cylindrical shaped pores are meso-pores. Preferably at least 80%, more preferably at least 85%, even more preferably 90% of the cylindrical shaped pores have a pore diameter below 35 nm and above 50 Å. Preferably at least 80%, more preferably at least 85%, even more preferably 90% of the cylindrical shaped pores have a pore diameter below 35 nm and above 60

Å. Preferably at least 80%, more preferably at least 85%, even more preferably 90% of the cylindrical shaped pores have a pore diameter below 35 nm and above 70 Å.

The pore volume distribution can be determined by mercury intrusion porosimetry, for example using the standard test methods issued under ASTM D 4284, such as ASTM D 4284-03.

The catalyst used in the process according to the invention is typically prepared by first mixing an amorphous silica-alumina powder with a binder in the presence of some acid and water, and optionally extrusion aids (peptising step). The resultant mixture is then extruded, dried and calcined to obtain the carrier. The calcined carrier is then impregnated with a solution of a salt of the hydrogenation metal or metals, for example via the Pore Volume Impregnation technique. The impregnated carrier is then dried and calcined to obtain the final catalyst.

It has been found that the cylindricity of the pores of a catalyst carrier comprising amorphous silica alumina is mainly determined by several factors in the preparation process of the carrier. Factors that affect the cylindricity include the dispersibility of the amorphous silica-alumina powder (use of a fresh powder typically results in a higher cylindricity than use of an aged powder), the mixing time in the peptising step (a longer mixing time typically results in higher cylindricity), the amount of acid used in the peptising step (a larger amount of acid has a negative effect on cylindricity), the presence of negatively-charged ions in the peptising step for example by using poly-anionic extrusion aids or by applying back-titration with ammonia at the end of the mulling phase (negatively-charged ions typically have a positive effect on cylindricity and positively-charged ions a negative effect).

In the process according to the invention, the feedstock is contacted with hydrogen in the presence of the catalyst at elevated temperature and pressure. The temperatures are typically in the range of from 175 to 400° C., preferably of from 250 to 375° C., more preferably of from 300 to 370° C. The pressure is typically in the range of from 10 to 250 bar (absolute), preferably of from 20 to 80 bar (absolute). Hydrogen may be supplied at a gas hourly space velocity of from 100 to 10,000 normal liters (NL) per liter catalyst per hour, preferably of from 500 to 5,000 NL/L·hr. The feedstock may be provided at a weight hourly space velocity of from 0.1 to 5.0 kg per liter catalyst per hour, preferably of from 0.5 to 2.0 kg/L·hr. The ratio of hydrogen to feedstock may range from 100 to 5,000 NL/kg and is preferably from 250 to 2,500 NL/kg.

Reference herein to normal liters is to liters at conditions of standard temperature and pressure, i.e. at 0° C. and 1 atmosphere.

After contacting the feedstock with the catalyst in the presence of hydrogen at elevated temperature and pressure as hereinabove described, a hydro-isomerised feedstock is obtained. The hydro-isomerised feedstock is preferably fractionated into at least a fraction boiling in the gasoil boiling range and a waxy raffinate product, preferably a waxy raffinate product. The fraction boiling in the gasoil boiling range, i.e. typically in the range of from 250 to 370° C., has excellent cold flow properties, in particular a low pour point and a low cloud point and may therefore suitably be used as diesel component.

The waxy raffinate product, i.e. the fraction typically boiling in the range of from 370 to 540° C. may be subsequently dewaxed to obtain a base oil by means of generally known solvent or catalytic dewaxing processes as described in for example EP 1 366 135 or EP 1 366 134. It is, however, an advantage of the process according to the invention that a waxy raffinate product is obtained that has a relatively low content of straight chain hydrocarbons and therefore can be used as base oil without a further dewaxing step, or with minimal dewaxing.

The waxy raffinate product may also be used in a traditional refinery environment to enhance the base oil production from a mineral oil feedstock.

EXAMPLES

Example 1

Comparative

Catalyst A was prepared using the following general procedure.

A mixture comprising amorphous silica-alumina (obtained from Grace Davison, water pore volume 1.1 ml/g, BET surface area 450 $m^2/g$, 13 mole % alumina; 1673 g dry basis) and alumina (obtained from Criterion Catalyst Co.; 717 g) was placed in a mulling machine and mulled for a period of 10 minutes. Acetic acid (10 wt % aqueous solution; 200.0 g) and water (2190.3 g) were added and the resulting mixture mulled for a further 10 minutes. Thereafter, polyacrylamide (Superfloc A1839, 2 wt % aqueous solution; 40.0 g) was added and mulling continued for a further 10 minutes. Finally, polyelectrolyte (Nalco, 4 wt % aqueous solution; 80.0 g) was added and the mixture mulled for a final period of 5 minutes.

The resulting mixture was extruded using a 5.7 cm (2.25") Bonnot extruder through a trilobe die plate, yielding 2.5 mm trilobe extrudates. The resulting extrudates were dried at a temperature of 120° C. for 2 hours and subsequently calcined at a temperature of 800° C. for 1.5 hours.

An aqueous solution was prepared comprising hexachloroplatinic acid ($H_2PtCl_6$, 2.45 wt %) and nitric acid (7.66 wt %) having a pH of below 1. The trilobe carrier particles were impregnated using this aqueous solution via the Pore Volume Impregnation technique to give a final platinum loading on the carrier of 0.8 wt %. The thus impregnated carrier particles were dried, and then calcined at a temperature of 540° C. for a period of 1 hour to yield the final catalyst.

The resulting catalyst had a surface area of 328 $m^2/g$ and a pore volume of 0.84 ml/g as measured by mercury intrusion porosimetry, and a median pore diameter of 86 Å as measured by mercury intrusion porosimetry. About 24% of the pore volume came from pores having a pore diameter above 35 nm. About 26% of the pore volume came from pores having a pore diameter below 70 Å and above 37 Å. The cylindricity was calculated to be 84% (33,600 $Å \cdot m^2/ml$).

Example 2

Catalyst B was prepared using the following procedure:

A mixture comprising amorphous silica-alumina (obtained from Grace Davison, water pore volume 1.3 ml/g, BET surface area 400 $m^2/g$, 13 mole % alumina; 70% dry basis), alumina (obtained from Criterion Catalyst Co.; 30% dry basis), acetic acid 70% (20% dry basis), Betz CPD92155 (2.5% dry basis), Superfloc N100 (1.5% dry basis), Methocel (1% dry basis), and sufficient water to arrive at a final Loss on Ignition at 600° C. of 62%, was placed in a mulling machine and mulled for a period of 25 minutes.

The resulting mixture was extruded using a 5.7 cm (2.25") Bonnot extruder through a trilobe dieplate, yielding 2.5 mm trilobe extrudates. The resulting extrudates were dried at a temperature of 120° C. for 2 hours and subsequently calcined at a temperature of 750° C. for 1 hour, and again at 800° C. for 1 hour.

An aqueous solution was prepared comprising hexachloroplatinic acid ($H_2PtCl_6$, 2.45 wt %) and nitric acid (7.66 wt %) having a pH of below 1. The trilobe carrier particles were impregnated using this aqueous solution via the Pore Volume Impregnation technique to give a final platinum loading on the carrier of 0.8 wt %. The thus impregnated carrier particles were dried, and then calcined at a temperature of 540° C. for a period of 1 hour to yield the final catalyst.

The resulting catalyst had a surface area of 291 $m^2/g$, a pore volume of 0.84 ml/g as measured by mercury intrusion porosimetry, and a median pore diameter of 107 Å as measured by mercury porosimetry. About 18% of the pore volume came from pores having a pore diameter above 35 nm. About 17% of the pore volume came from pores having a pore diameter below 70 Å and above 37 Å. The cylindricity was calculated to be 93% (37,200 ($m^2$/ml)·Å).

Example 3

Each sample was tested for performance in the preparation of a waxy raffinate feedstock for the production of a lubricating base oil using the following general procedure:

In two different experiments, a feedstock having the boiling characteristics as given in Table 1 was subjected to a hydrocracking/hydro-isomerisation step using catalyst A and B, respectively. The conditions in the hydrocracking/hydro-isomerisation step were the following for both experiments: a feedstock Weight Hourly Space Velocity (WHSV) of 1.0 kg/L·hr, a hydrogen gas rate of 1,000 NL/kg feedstock, a total pressure of 31 bar (absolute), and recycle of the product boiling above 540° C. The reactor temperature needed to achieve 50% conversion of compounds boiling above 370° C. into compounds boiling below 370° C. was as listed in Table 2. The yields of the fraction boiling between 200 and 370° C. (gasoil product) and of the fraction boiling between 400 and 540° C. (waxy raffinate product) were as given in Table 2. Several cold flow properties of the gasoil fraction boiling between 250 and 345° C. were determined: the cloud point was determined according to ASTM D2500; the cold filter plugging point (CFPP) was determined according to D6371; and the pour point was determined according to ASTM D97. The wax content of the waxy raffinate fraction boiling between 370 and 540° C. was determined. The results are given in Table 2.

TABLE 1

Boiling characteristics of feed

| Boiling point | fraction boiling below listed boiling point (% weight) |
|---|---|
| 370° C. | 18.1 |
| 540° C. | 38.2 |

TABLE 2

Process conditions and product characteristics

| Catalyst | A | B |
|---|---|---|
| Cylindricity | 84% | 93% |
| Reactor Temperature (° C.) | 340 | 345 |
| Conversion of fraction boiling above 370° C. | 51.2% | 51.5% |

TABLE 2-continued

Process conditions and product characteristics

| Catalyst | A | B |
|---|---|---|
| Yield of gasoil (fraction boiling between 200 and 370° C.) | 24.5% weight on feed | 30.4% weight on feed |
| Cold flow properties of gasoil fraction boiling between 250 and 345° C. | | |
| cloud point (° C.) | −12 | −24 |
| CFPP (° C.) | −15 | −21 |
| pour point (° C.) | −19 | −27 |
| Yield of waxy raffinate fraction boiling between 400 and 540° C. | 15.2% weight on feed | 16.7% weight on feed |
| Wax content of fraction boiling between 370 and 540° C. (solvent dewaxing at −20° C.) | 12% | 4% |

As can be seen by comparing the results from the process using catalyst B (invention) and the process using catalyst A (comparative), the yield of the fraction boiling between 400 and 540° C. is higher in the process using catalyst B as compared to the process using catalyst A. The wax content of the base oils precursor fraction boiling between 370° C. and 540° C. is also lower in the process using catalyst B, which shows that catalyst B isomerises the Fischer-Tropsch wax better than catalyst A.

Moreover, the cold flow properties of the gasoil product obtained in the process using catalyst B have significantly improved as compared to the cold flow properties of the gasoil product obtained in the process using catalyst A.

The invention claimed is:

1. A process for hydrocracking and hydro-isomerisation of a paraffinic feedstock obtained by Fischer-Tropsch hydrocarbon synthesis comprising at least 50 wt % of components boiling above 370° C. to obtain a hydro-isomerised feedstock, the process comprising contacting the feedstock, in the presence of hydrogen, at elevated temperature and pressure with a catalyst comprising a hydrogenating compound supported on a carrier comprising amorphous silica-alumina having less than 10 wt % of crystalline phase, the carrier having a pore volume of at least 0.8 ml/g, wherein at most 40% of the pore volume comes from pores having a pore diameter above 35 nm and wherein at most 20% of the pore volume comes from pores having a pore diameter below 50 Å and above 37 Å, the carrier having a median pore diameter of at least 85 Å, wherein the pores of the carrier are characterized by a product of (pore surface area per pore volume) and (median pore diameter) ranging from 34,000 Å·$m^2$/ml to 44,000 Å·$m^2$/ml, where pore surface area is determined by BET nitrogen adsorption and pore volume and median pore diameter are determined by mercury intrusion porosimetry.

2. A process according to claim 1, wherein the feedstock obtained by Fischer-Tropsch hydrocarbon synthesis comprises at least 70 wt % of components boiling above 370° C.

3. A process according to claim 1, wherein the product of surface area per pore volume and median pore diameter as measured by mercury porosimetry of the carrier is at least 36,000 Å·$m^2$/ml.

4. A process according to claim 1, wherein at most 20% of the pore volume comes from pores having a pore diameter below 60 Å and above 37 Å.

5. A process according to claim 1, wherein the carrier has a median pore diameter of at least 100 Å.

6. A process according to claim 1, wherein the feedstock has a weight ratio of compounds boiling above 540° C. and compounds boiling between 370 and 540° C. of greater than 2.

7. A process according to claim 1, wherein the hydrogenating compound is a noble metal.

8. A process according to claim 7, wherein the catalyst comprises the noble metal in a concentration in the range of from 0.05 to 2.0 wt % based on the weight of carrier.

9. A process according to claim 1, wherein, the feedstock is contacted with the catalyst at a temperature in the range of from 175 to 400° C.

10. A process according to claim 1, wherein, the feedstock is contacted with the catalyst at a pressure in the range of from 10 to 250 bar (absolute).

11. A process according to claim 1, further comprising fractionating the hydro-isomerised feedstock into at least a fraction boiling in the gasoil boiling range and a waxy raffinate product.

12. A process according to claim 11, further comprising dewaxing the waxy raffinate product to obtain a base oil.

* * * * *